United States Patent [19]

Lamb et al.

[11] Patent Number: 4,573,678

[45] Date of Patent: Mar. 4, 1986

[54] LOWER EXTREMITY MUSCLE CONDITIONER DEVICE

[76] Inventors: Steve Lamb, 2772 Sydney Way, Castro Valley, Calif. 94546; Robert R. Moore, 4010 East Ave., Hayward, Calif. 94542; Frank La Porte, Jr., 3460 Revere Ave., Oakland, Calif. 94605

[21] Appl. No.: 500,554

[22] Filed: Jun. 2, 1983

[51] Int. Cl.[4] ..... A63B 1/00; A63B 23/04

[52] U.S. Cl. ..... 272/96; 272/70

[58] Field of Search ..... 272/96, 97, 70, 94, 272/93, 105, 144–146, DIG. 9, DIG. 10; 128/25 R, 25 B; 273/188 R, 188 A

[56] References Cited

U.S. PATENT DOCUMENTS

| | | | |
|---|---|---|---|
| 1,561,516 | 11/1925 | Glowa | 272/70 |
| 2,021,801 | 11/1935 | Meyer | 272/96 |
| 2,041,693 | 5/1936 | Boltz et al. | 272/96 |
| 3,297,320 | 1/1967 | Di Benedetto | 272/DIG. 10 |
| 3,741,540 | 6/1973 | Shimizu | 272/96 |
| 4,086,921 | 5/1978 | Gonzales et al. | 128/25 B |
| 4,111,416 | 9/1978 | Jinotti | 272/96 |
| 4,206,558 | 6/1980 | Bivona | 272/70 |
| 4,371,160 | 1/1983 | Shooltz | 272/96 |

FOREIGN PATENT DOCUMENTS

| | | | |
|---|---|---|---|
| 0073744 | 3/1983 | European Pat. Off. | 272/96 |

*Primary Examiner*—Richard J. Apley
*Assistant Examiner*—S. R. Crow
*Attorney, Agent, or Firm*—Bielen & Peterson

[57] ABSTRACT

An adjustable footgear that is strapped to a user's foot, the footgear having a base with an angularly adjustable sole platform connected by a heel pivot to the base, the platform having an associated manual adjustment mechanism for raising the toe end of the platform any select degree above the heel end to dorsiflex the foot upon walking such that the lower extremity muscles are stretched and conditioned.

6 Claims, 2 Drawing Figures

LOWER EXTREMITY MUSCLE CONDITIONER DEVICE

BACKGROUND OF THE INVENTION

This invention relates to mechanical footgear for conditioning the lower extremity muscles of a user. The device is particularly useful for athletes who wish to improve their athletic performance.

Equipment for athletic training is diverse with special application to a variety of conditioning techniques for specific muscle groups. A substantial portion of mechanical equipment is devoted to muscle buildup where the major muscle configurations are enlarged through contraction under applied resistance. In any training program, particularly where muscle enlargement may occur, it is necessary to include exercises and conditioning techniques to stretch an athletic trainee's muscles to prevent constriction of movement. This is particularly important where athletic performance is dependent on dynamic ability or speed. In such activities performance requires a muscle tone, conditioned for stretch as well as contraction.

Where there are many conditioning routines designed for extension of the foot, there are few routines for a complimentary contraction of the foot for stretching tight heel cords. Runners often stretch such cords and accompanying muscles by leaning forward into a wall or support to angle backwardly extended feet, either together or individually. This is part of a common warmup routine, but is rarely an extended part of a conditioning program.

Such routines provide little comparative data for the trainee to determine the state of his physical condition and are largely limbering exercises. Further, such routines are difficult to integrate into a training program with prolonged conditioning to provide gradual stretching of muscles and tendons of lasting duration.

The muscle conditioner device of this invention provides the trainee with a specially devised foot-gear that can be incorporated into a simple, effective routine to provide measurable changes in plantar flexion that enhances the athletic performance of the user.

SUMMARY OF THE INVENTION

The lower extremity muscle conditioner device of this invention is a footgear that is strapped to the user's foot or athletic shoe. The footgear is formed by a pair platform structures to elevate the front of the foot above the heel. Each of the platform structures is fastened to a foot support to cause the user's feet to be in a toe up position, thereby stretching the muscle and tendon compliments involved in plantar flexion on walking. The platform structures each include an adjustment mechanism for varying the angle of incline of a sole platform enabling the trainee to gradually increase the angle for a resultant increase in the dorsiflex of the foot. A resultant stretching of those structures involved in plantar flexion occurs, including the peroneus longus, peroneus brevis, gastroenenius, soleus, plantaris and other associated structures of the foot leg and buttocks.

The adjustable foot conditioner device has been found to be particularly helpful in increasing vertical jump and is therefore advantageous for incorporation into the training program of athletes in basketball, volleyball, broad jumping and high jumping. The enhancement of stretching is beneficial to sports requiring agility and speed including track, football baseball and swimming. Additionally, under the supervision of a qualified trainer or physician, the device may be used therapeutically for relief of tightness in hamstring, shin splints, pulled calf muscles and Achilles tendonitis.

The conditioner device is simple to use, the footgear being strapped to the bottom of the foot or athletic shoe. Each platform structure is adjustable from a front adjustment knob to platform inclination that moderately stresses the Achilles tendon. The trainee walks on a flat surface to dynamically work the tendons and muscles. The angle of inclination and duration of use should be limited to prevent over stress, particularly during initial stages of use. Gradual increases in the angle of inclination and duration of use provide the gradual stretching and elongation of the musculature which enhances the user's agility, acceleration and overall athletic performance.

DETAILED DESCRIPTION OF THE PREFERRED EMBODIMENT

Figure 1:
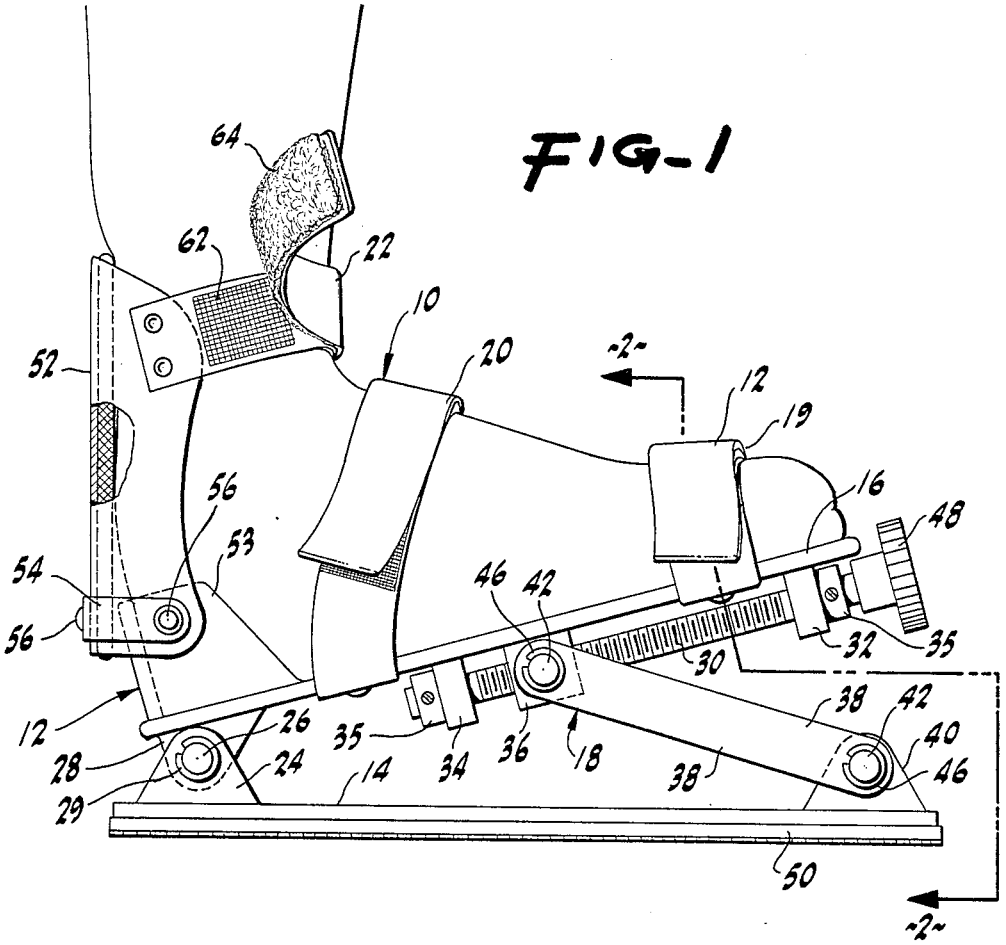
FIG. 1 is a perspective view of the foot conditioner device.

Referring to FIG. 1, the device of this invention designated in general by the reference numeral 10, comprises a footgear for conditioning the muscles and tendons of the lower extremities. The footgear includes a pair of platform shoes 12, (one shown in the drawings) each constructed with a base 14 designed for stable contact with a flat ground surface, a platform 16 for seating the underside of an athletic shoe, and an interconnecting, elevating mechanism 18 for raising or lowering the angular inclination of the platform with respect to the base. The user steps onto the platform 16 of each platform shoe 12, and fastens a toe strap 19, a foot strap 20 and an ankle strap 22 attached to the platform 16 over his foot or athletic shoe to secure the platform structure to his foot.

The platform 16 is pivotally connected to the base 14 by a pivot unit located at the heel end of the platform shoe and a jack unit located at the toe end of the shoe. The pivot unit includes a pin mount 24 on the top of the heel end of the base, a horizontal cross pin 26 through the pin mount and a cooperating bracket mount 28 on the underside of the platform, which pivotally engages the cross pin 26. A pair of C-clips 29 retain the cross pin 26. In this arrangement the platform 16 is permitted limited rotation about the axis of the cross pin allowing the toe end of the platform to be elevated above the heal end, imparting an angle of inclination to the platform. In the preferred embodiment, the elevating mechanism 18 permits continuous adjustment of the platform from an inclination of 15° to 35°. Certain uses, for example therapeutic, may require a lower range, i.e. from 0° to 20°.

Figure 2:
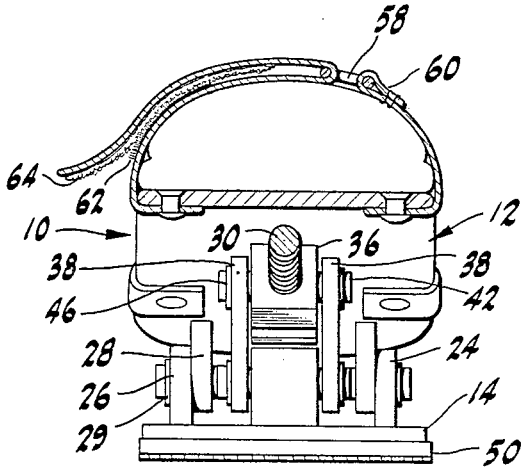
FIG. 2 is a cross sectional view taken on the lines 2—2 in FIG. 1.

As also shown in FIG. 2, in order to adjust and maintain the inclination desired, a turn screw 30 is rotationally mounted to the underside of the platform in forwarded and aft journal bearing blocks, 32 and 34, respectively and retained by retainer rings 35. The turn screw 30 threadably engages a movable carriage block 36. The carriage block 36 in turn is connected by two parallel links 38 to a toe mount 40 on the base 14. The links 38 are pivotally retained by pins 42, with engaged C-clips 46. Rotation of the knob 48 at the end of the turn screw 30 moves the carriage block 36 forward or aft to respectively raise or lower the inclination of the platform.

The platform 16 and base 14 of each member of the footgear are cast from a lightweight material such as aluminium. The base 14 has a padded bottom sole 50 to protect floor surfaces and resist slippage. The platform 16 includes an ankle brace 52 that is fastened to a heel portion 53 of the platform by a clip 54 with rivets 56. The ankle brace provides lateral support to prevent inadvertent injury during use, as well as to aid in positioning the ankle strap 22 for strapping the foot gear snugly to the user's feet.

The straps are fabricated from a strong web material and have a loop buckle 58 connected by a sewn strap loop 60 to one end of each of the straps. The other end of each of the straps has synthetic hook and mat pads 62 and 64. The pads adhere together when the end of the strap is looped through the buckle 58 and the two adjacent pads are pressed together. This method of fastening the straps allows tightening to any degree desired, and quick release as necessary.

The arrangement of the elevating mechanism 18 with the base 14 and platform 16 is preferred. However, it is to be understood that the mechanism could be easily inverted with the adjustment screw mounted to the base or, reversed, with the heel raised or lowered from an elevated pivot at the toe.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. Footgear for conditioning the lower extremities of a user's leg comprising a pair of separated, independent platform shoes each shoe comprising:

a base constructed for stable contact with a flat ground surface, a platform mounted on top of said base said platform having a heel portion and a toe portion, said platform being inclined to a selectably fixed position with respect to said base with said toe portion elevated above said heel portion, an adjustable elevating mechanism interconnecting said platform and base for select adjustment of the angular inclination of said platform with respect to said base, and strap means for securing a user's foot to said platform with the user's heel positioned on the heel portion of said platform and the user's toes positioned on the toe portion of said platform, wherein said strap means is adapted to secure said platform shoes to the user's foot when the user lifts his foot from the ground surface during a therapeutic walking regimen; wherein said adjustable elevating mechanism includes a heel pivot and a toe jack, said toe jack comprising a screw with journal blocks and a rotation knob at the end of the screw, a displaceable carriage block threadably engaging said screw, and at least one connecting link connected to said carriage block, said screw and connecting link interconnecting said base and platform wherein upon turning said rotation knob the angular disposition of said platform relative to said base is continuously varied.

2. The footgear of claim 1 wherein said heel pivot comprises a pin mount on top of said base, a horizontal pivot pin engaged with said pin mount, and a bracket mount on the underside of said platform engaged with said pivot pin whereby said platform is pivotable with respect to said base about said pivot pin.

3. The footgear of claim 1 wherein said screw has first and second ends, said toe jack including first and second journal blocks fixed to said platform wherein said carriage block is displaced between said first and second journal blocks on rotation of said screw.

4. The footgear of claim 3 wherein said screw has said knob fixed to said first end of said screw, said knob projecting from the toe end of said shoe.

5. Footgear for conditioning the lower extremities of a user's leg comprising a pair of separated, independent platform shoes each shoe having:

a base constructed for stable contact with a flat ground surface;

a platform mounted on top of said base, said platform having means for securing a user's foot thereon, an adjustable elevating mechanism interconnecting said platform and base for adjusting the angular inclination of said platform with respect to said base, wherein said adjustable elevating mechanism include a heel pivot and a toe jack, said toe jack comprising a screw mechanism having a rotatable screw with first and second ends respectively engaging first and second journal blocks fixed to said platform and a rotation knob at the first end of the screw projecting from said first journal block, a displaceable carriage block threadably engaging said screw, wherein said carriage block is displaced between said first and second journal blocks on rotation of said screw, and, at least one connecting link connected to said carriage block, said screw and connecting link interconnecting said base and platform wherein upon turning said rotation knob the angular disposition of said platform relative to said base is continuously varied.

6. The footgear of claim 5 wherein said knob projects from the toe end of said shoe.

* * * * *